US011065685B2

(12) United States Patent
Huber et al.

(10) Patent No.: US 11,065,685 B2
(45) Date of Patent: Jul. 20, 2021

(54) SLINGER RING

(71) Applicant: PLANSEE SE, Reutte (AT)

(72) Inventors: Thomas Huber, Reutte (AT); Katrin Knittl, Reutte (AT); Wolfram Knabl, Reutte (AT); Wolfgang Simader, Reutte (AT)

(73) Assignee: Plansee SE, Reutte (AT)

( * ) Notice: Subject to any disclaimer, the term of this patent is extended or adjusted under 35 U.S.C. 154(b) by 0 days.

(21) Appl. No.: 16/626,644

(22) PCT Filed: Jun. 12, 2018

(86) PCT No.: PCT/AT2018/000055

§ 371 (c)(1),
(2) Date: Dec. 26, 2019

(87) PCT Pub. No.: WO2019/000001

PCT Pub. Date: Jan. 3, 2019

(65) Prior Publication Data

US 2020/0222985 A1 Jul. 16, 2020

(30) Foreign Application Priority Data

Jun. 30, 2017 (AT) ..... GM 153/2017

(51) Int. Cl.

| | |
|---|---|
| ***B22D 11/06*** | (2006.01) |
| ***B22F 3/17*** | (2006.01) |
| ***B22F 3/06*** | (2006.01) |
| ***B22F 3/18*** | (2006.01) |
| ***C22F 1/18*** | (2006.01) |
| *B21J 9/02* | (2006.01) |

(52) U.S. Cl.

CPC ..... *B22F 3/17* (2013.01); *B22D 11/0651* (2013.01); *B22F 3/06* (2013.01); *B22F 3/18* (2013.01); *C22F 1/18* (2013.01); *B21J 9/025* (2013.01); *B22D 11/0611* (2013.01)

(58) Field of Classification Search

CPC ..... B22D 11/0611; B22D 11/0651; B22D 11/0682

See application file for complete search history.

(56) References Cited

U.S. PATENT DOCUMENTS

| | | | |
|---|---|---|---|
| 4,589,471 | A | 5/1986 | Gigliotti, Jr. et al. |
| 5,564,490 | A | 10/1996 | Liebermann et al. |
| 5,842,511 | A | 12/1998 | Raybould et al. |
| 6,183,572 | B1 | 2/2001 | Panchanathan et al. |

(Continued)

FOREIGN PATENT DOCUMENTS

| | | | |
|---|---|---|---|
| DE | 69619106 | T2 | 8/2002 |
| DE | 69712091 | T2 | 11/2002 |

(Continued)

*Primary Examiner* — Kevin E Yoon

(74) *Attorney, Agent, or Firm* — Laurence A. Greenberg; Werner H. Stemer; Ralph E. Locher

(57) ABSTRACT

A slinger, or slinger ring, for a melt spinning apparatus has a cylindrical, mechanically shaped main element that is composed of a refractory metal or a refractory metal-based alloy and has a circumferential surface running in a tangential direction. The circumferential surface is delimited in the axial direction by two end faces. A degree of deformation in the radial direction is greater than the degree of deformation in the axial direction.

10 Claims, 13 Drawing Sheets

(56) References Cited

U.S. PATENT DOCUMENTS

| | | | | |
|---|---|---|---|---|
| 6,187,217 | B1 * | 2/2001 | Arai | B22D 11/0611 148/302 |
| 6,317,020 | B1 | 11/2001 | Nakagawa et al. | |
| 6,764,556 | B2 | 7/2004 | Myojin et al. | |
| 6,890,392 | B2 | 5/2005 | Kanekiyo et al. | |
| 7,291,231 | B2 | 11/2007 | Myojin et al. | |

FOREIGN PATENT DOCUMENTS

| | | | |
|---|---|---|---|
| DE | 60102278 | T2 | 7/2004 |
| DE | 10392662 | T5 | 9/2005 |
| DE | 102007061964 | A1 | 7/2009 |
| DE | 112004001542 | B4 | 5/2014 |
| EP | 1207537 | A1 | 5/2002 |
| WO | 7901054 | A1 | 12/1979 |
| WO | 2009083045 | A2 | 7/2009 |

* cited by examiner

SLINGER RING

BACKGROUND OF THE INVENTION

Field of the Invention

The invention relates to a slinger ring for a melt spinning apparatus, comprising a cylindrical, mechanically shaped main element which is composed of a refractory metal or a refractory metal-based alloy and which has a circumferential surface running in a tangential direction, which surface is delimited in the axial direction by two end faces, a melt spinning apparatus comprising such a slinger ring and a process for producing a slinger ring wherein a blank, in particular a sintered blank, composed of refractory metal or a refractory metal-based alloy is mechanically shaped.

A slinger ring of the type in question (also known as quenching wheel, spun wheel, spun ring, spinning wheel, rotating wheel), a melt spinning apparatus comprising such a slinger ring and a process of the type in question are disclosed in U.S. Pat. No. 6,183,572 B1.

A problem is the fact that the operating life of such slinger rings and thus the long-term usability of the melt spinning apparatus is limited by crack formation.

SUMMARY OF THE INVENTION

It is an object of the invention to provide a slinger ring of the type in question, a melt spinning apparatus comprising such a slinger ring and a process for producing a slinger ring, in which the problems discussed above are avoided.

This object is achieved by a slinger ring as claimed, a melt spinning apparatus comprising such a slinger ring and a process for producing a slinger ring as claimed. Advantageous embodiments of the invention are defined in the dependent claims.

The invention is based on the recognition that a plurality of grain boundaries which run tangentially promotes the abovementioned crack formation. An axial main forming direction as in the prior art leads to greater crack formation, especially along the tangential direction, preferably on the circumferential surface. Relocating the main forming direction into the radial direction reduces the number of grain boundaries in the tangential direction on the circumference surface and thus the tendency for cracks to be formed.

For the purposes of the present invention, the term refractory metal refers to the metals tungsten and molybdenum. Refractory metal-based alloys are alloys based on one or more of the abovementioned refractory metals, with the proportion of refractory metal or refractory metals being greater than 50 at %, preferably greater than 80 at %, more preferably greater than 95 at %. It goes without saying that a refractory metal or a refractory metal-based alloy can also contain usual impurities which originate from the raw materials or are introduced via the production process.

Particular preference is given to the slinger ring consisting of a molybdenum-based alloy.

Further preference is given to the slinger ring consisting of a molybdenum-based alloy comprising ≥99 at % of molybdenum, or of MHC or of TZM. The term MHC refers to a molybdenum-based alloy which contains about 1.2% by weight of hafnium and also from 0.05 to 0.12% by weight of carbon. The term TZM refers to a molybdenum-based alloy which contains from 0.4 to 0.55% by weight of titanium, from 0.06 to 0.12% by weight of zirconium and from 0.01 to 0.04% by weight of carbon.

The particular suitability of TZM as alloy for a slinger ring according to the invention can be due to a number of influencing factors. Firstly, the alloy TZM has particularly advantageous mechanical properties and improved high-temperature properties because of the alloying elements used, and secondly an advantageous microstructure is established by a degree of deformation which is greater in the radial direction than that in the axial direction. Furthermore, the increased grain boundary strength of TZM compared to molybdenum is particularly advantageous.

MHC likewise has improved mechanical properties which are partly due to the mixed crystal strengthening of molybdenum by means of hafnium. MHC additionally has improved high-temperature properties compared to TZM.

The degree of extension of the grains of a microstructure can be described by the grain aspect ratio, which indicates the ratio of grain length to grain width.

The average circumference-side grain aspect ratio ($k_U$) is obtained in plan view onto the circumferential surface, and the average end-face-side grain aspect ratio ($k_S$) is obtained in plan view onto one of the end faces, as described below.

According to the invention, it is preferred that (where $k_U$ is always less than $k_S$):

$$1<k_U<1.7, \text{ preferably } 1<k_U<1.4;$$

$$k_S\geq 1.5, \text{ preferably } k_S\geq 1.8.$$

Due to the greater deformation in the radial direction, there may be more grain boundaries in the region of the end faces of the main element, but this is irrelevant to the operating life of the slinger ring.

The invention also has advantageous effects on the average grain size ($d_{mean}$), which is measured by a method based on ASTM E 112 by the line intercept method and which on the circumferential surface is, for example, less than 500 μm, preferably less than 200 μm, particularly preferably less than 100 μm.

It has been found that the main element can have the preferential orientation(s) <111> and/or <100> normal to the circumferential surface. The absence of a <101> preferential orientation normal to the circumferential surface is advantageous.

Further preference is given to a preferential orientation normal to the circumferential surface in the <111> direction with an intensity greater than 1.5 times the underlying intensity.

The crystal orientation, also referred to as preferential orientation or forming texture, is preferably determined by means of SEM (scanning electron microscopy) and EBSD (electron backscatter diffraction). The specimen (normal to the circumferential surface) is for this purpose tilted by an angle of 70°. The incident primary electron beam is inelastically scattered at the atoms of the specimen. When some electrons impinge in this way on lattice planes in such a way that the Bragg condition is satisfied, constructive interference occurs. This reinforcement occurs for all lattice planes in the crystal, so that the resulting diffraction pattern (electron backscatter pattern, also known as Kikuchi Pattern) encompasses all angle relationships in the crystal and thus also the crystal symmetry. The measurement is carried out under the following conditions:

Accelerating voltage: 20 kV,
Orifice 120 μm,
Working distance 15 mm
High-current mode—activated
Scanned area: 1690×1690 $\mu m^2$,
Index step width: 2 μm.

BRIEF DESCRIPTION OF THE SEVERAL VIEWS OF THE DRAWING

Working examples of the invention will be discussed with the aid of the figures. The figures show.

DESCRIPTION OF THE INVENTION

Figure 1:
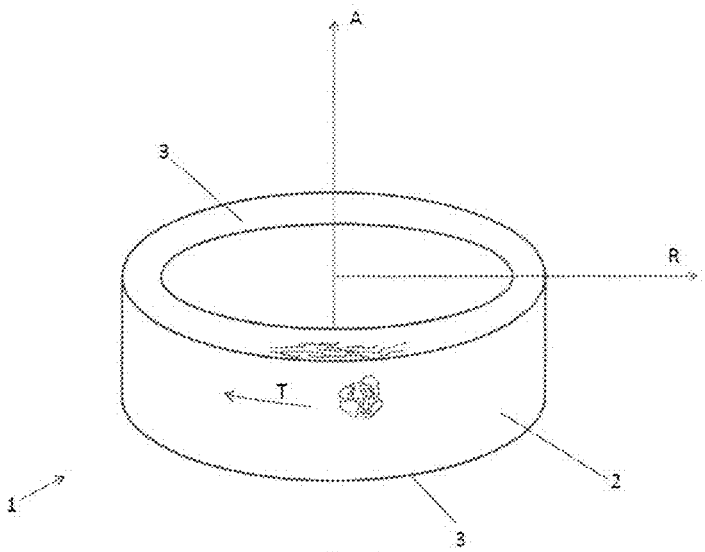
FIG. 1 a schematic depiction of a slinger ring according to the invention

FIG. 1 shows a slinger ring 1 according to the invention, with the axial direction A, the radial direction R and the tangential direction T having been drawn in. The slinger ring 1 has a cylindrical main element whose circumferential surface 2 is delimited by two end faces 3. In the working example shown, the slinger ring 1 is configured as a hollow cylinder in order to save material. A drive device for driving the slinger ring 1 can engage in the interior hollow space. As indicated, the grain elongation on the end faces of the slinger ring runs primarily in the tangential direction T.

Figure 2:
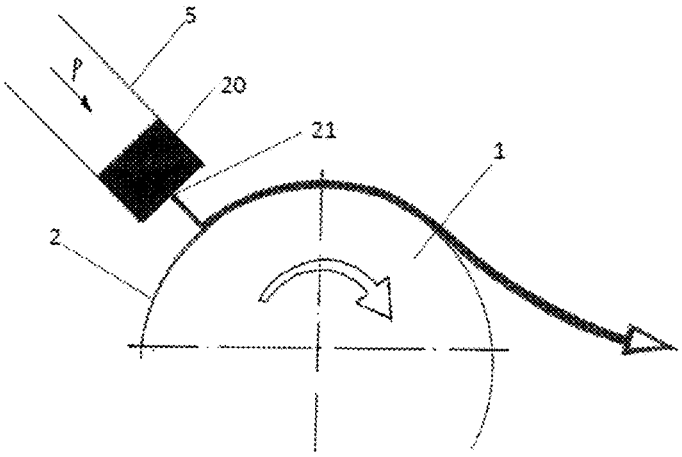
FIG. 2 a schematic depiction of a melt spinning apparatus according to the invention FIG. 3*a*, 3*b* a schematic illustration of the inventive concept, a) prior art, b) slinger ring according to the invention, edge length of the microstructure section (cube) 500 μm FIG. 4 an optical micrographic section as per the invention (circumferential surface, etched)

FIG. 2 shows a schematic depiction of a melt spinning apparatus according to the invention. Here, the slinger ring 1 described in FIG. 1 is connected to a drive unit (which for reasons of simplicity is not shown) which brings about rotation of the slinger ring 1 about its rotationally symmetric axis. The slinger ring 1 is cooled by means of a cooling apparatus (which for reasons of simplicity is not shown). Such cooling of the slinger ring can, for example, be effected by means of air cooling, water cooling or by means of a different medium which is either brought to the circumferential surface 2 of the slinger ring or to its inside. Melt 20 is applied to the circumferential surface 2 of the slinger ring 1 by means of a device 5 for applying melt 20. This is in this example carried out by introducing melt 20 into the interior of the device 5 for applying melt 20 and subsequently exerting a compressive force P on the melt 20, so that it leaves the device 5 for applying melt 20 through an application nozzle 21. The melt 20 solidifies by heat transfer as a result of it transferring heat to the cool slinger ring 1 and is carried along by the latter until the melt 20 is flung off by the centrifugal force of the slinger ring 1.

Figure 3:
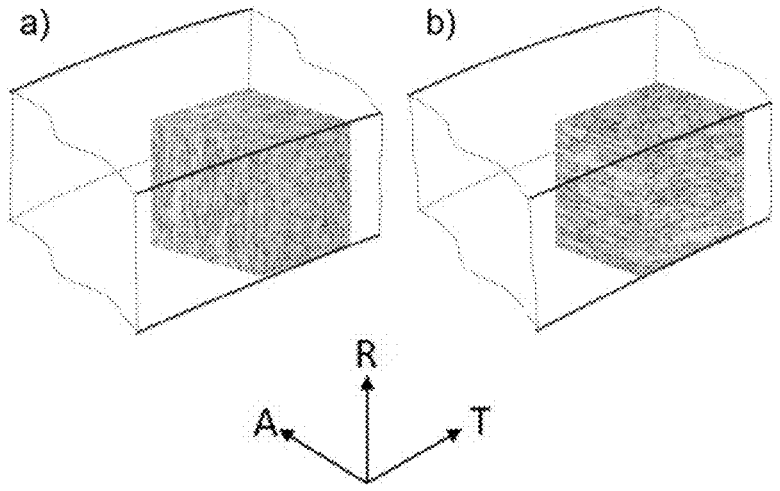

FIGS. 3*a* and 3*b* illustrate the inventive concept, with FIG. 3*a* showing the microstructure in the case of a slinger ring according to the prior art and FIG. 3*b* showing the microstructure in the case of a slinger ring according to the invention. A cube-shaped microstructure section having an edge length of 500 μm is depicted in each case. The position of the microstructure section relative to the directions in the slinger ring is indicated by means of the coordinate system.

In the prior art, the main deformation is in the axial direction A. The microstructure which is established displays a plurality of grain boundaries running in the tangential direction T, see FIG. 3*a*. This microstructural characteristic promotes crack formation at the circumferential surface of the slinger ring.

When the main forming direction is translocated into the radial direction R, the number of grain boundaries in the tangential direction T on the circumferential surface and thus the tendency for cracks to be formed are reduced. This configuration of the microstructure in a slinger ring according to the invention is shown in FIG. 3*b*.

Figure 4:
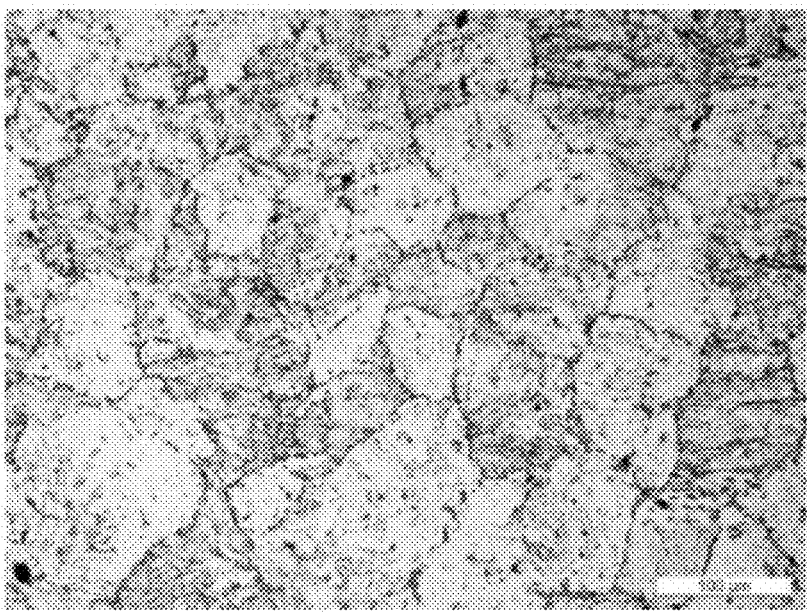

As a result of the main element of the slinger ring 1 having been produced in a mechanical forming process whose main forming direction H has been selected so that it runs in the radial direction R of the finished slinger ring 1, the circumferential surface 2 of the slinger ring 1 has a far smaller number of grain boundaries than is the case in the prior art. This can be seen particularly well in a comparison of FIGS. 4 and 5.

Figure 5:
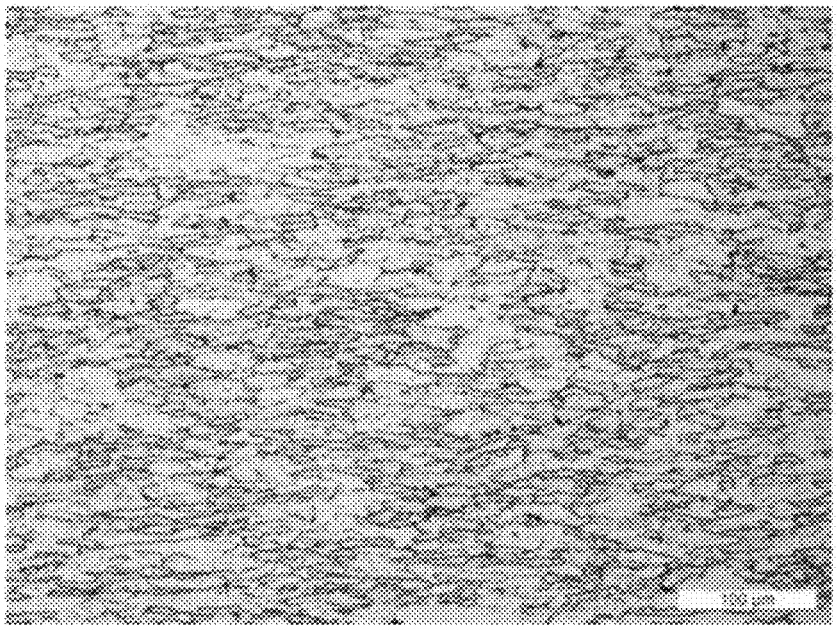
FIG. 5 an optical micrographic section as per the prior art (circumferential surface, etched)

Both figures show optical micrographs of etched sections, which were taken of the circumferential surface 2 of a slinger ring 1 according to the invention (FIG. 4) or according to the prior art (FIG. 5). In the case of the invention, it can be seen that far fewer grain boundaries are present on the circumferential surface, which makes formation of cracks along grain boundaries more difficult (especially because of the thermal stressing caused by the impinging melt).

The determination of the average circumference-side and end-face-side grain aspect ratios $k_u$ and $k_s$, and also the average grain size $d_{mean}$, is carried out by optical microscopic evaluation of metallographic polished sections.

Figure 7A:
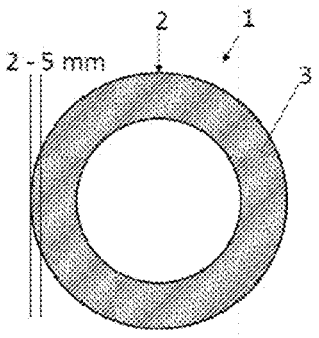
Figure 7B:
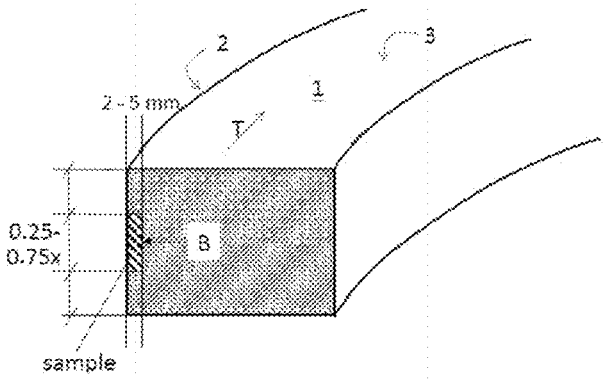

FIGS. 7*a* and 7*b* illustrate the position of the taking of samples for the metallographic studies on a slinger ring 1.

FIG. 7*a* shows a section parallel to the end face 3 to indicate the specimen thickness in the range from 2 to 5 mm, while FIG. 7*b* shows a cross section of the slinger ring 1 perpendicular to the tangential direction T.

The specimens for the optical microscopic studies were taken at the circumferential surface 2 with a length of from 0.25 to 0.75 times the ring height (FIG. 7*b*) in order to avoid edge effects from the peripheral zone of the material as far as possible. The sampling region is denoted by "sample". The preparation and examination of the specimen were carried out at the radially interior side of the specimen. The viewing direction is denoted by the letter B in FIG. 7*b*.

The preparation of the metallographic specimens was carried out as follows:

- embedding in Bakelite body 032 mm at a temperature of 180° C. and force of 20 kN
- wet grinding on SiC paper using the grain sizes 120, 320, 600, 800, 1500, 2400 for 30 seconds in each case
- polishing:
  - 3 μm diamond suspension on polishing cloth
  - 1 μm diamond spray on polishing cloth
  - 0.1 μm OPS polishing cloth
  - contact pressure 10N, duration 30 min, speed of rotation 30 rpm The prepared polished sections were examined under LEICA optical microscopes (for example LEICA DMI 5000 M). To examine the grain size and grain elongation, grain boundary etchings were carried out on the polished specimens by means of Murakami etching solution. The Murakami etching solution consists of potassium hydroxide KOH and potassium ferricyanide K3[Fe(CN)6].

The quantitative evaluation of the average grain size was carried out by a procedure based on the line intercept method in accordance with ASTM E112. For this purpose, pictures with 200×enlargement were taken and the number of grain boundaries in the axial and tangential direction, when the measurement concerns the circumferential surface and the determination of $k_u$, or in the radial and tangential direction, when the measurement concerns one of the end faces and the determination of $k_s$, is in each case counted. The grain boundaries are counted along equidistant 1500 μm long lines which are drawn at a spacing of at least 100 μm in the image plane in both directions spanning the image plane (circumferential surface: axial and tangential, or end faces: radial and tangential). To obtain satisfactory statistics, the image enlargement per polished section image is reduced and the number of polished section images per specimen can also be increased.

(Direction-independent) grain aspect ratios $k_u$ for the circumferential surface or $k_s$ for the end face are given by the ratio of the larger number of grain boundaries determined divided by the smaller number of grain boundaries. In the evaluation methodology described, it has to be ensured that the value for the direction having the larger number of grain boundaries is divided by the value for the direction having the smaller number of grain boundaries.

The average grain size $d_{mean}$ is given by the mean of the two average grain sizes in each measurement direction using a method based on the evaluation methodology of ASTM E112.

Figure 8A:
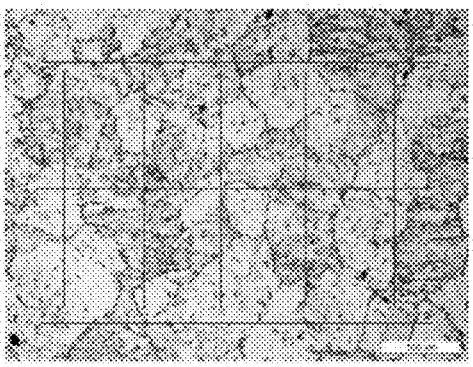
Figure 8B:
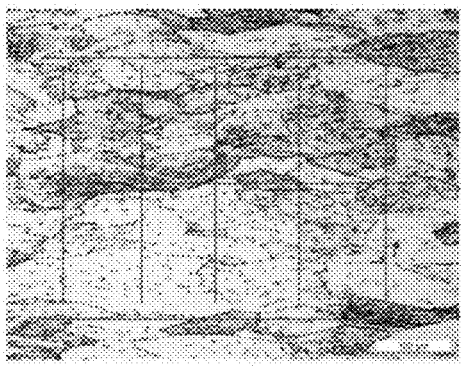

FIG. 8*a* shows a reference example for an evaluation of the circumferential surface:

Horizontal lines=axial direction:
27 grain boundaries
Average grain size 55.6 μm
Vertical lines=tangential direction:
25 grain boundaries
Average grain size 60.0 μm
Grain elongation $k_u$=27:25=1.08
Average grain size $d_{mean}$=(55.6 μm+60.0 μm)/2=57.7 μm FIG. 8*b* shows a reference example for an evaluation of the end face:

Horizontal lines=tangential direction:
21 grain boundaries
Average grain size 71.4 μm (line intercept method in accordance with ASTM E112)
Vertical lines=radial direction:
47 grain boundaries
Average grain size 31.9 μm (line intercept method in accordance with ASTM E112)
Grain elongation $k_s$=47:21=2.24
Average grain size $d_{mean}$=(71.4 μm+31.9 μm)/2=44.1 μm FIGS. 6*a*-6*f* show depictions of various mechanical forming processes which come into question for the invention.

Figure 6A:
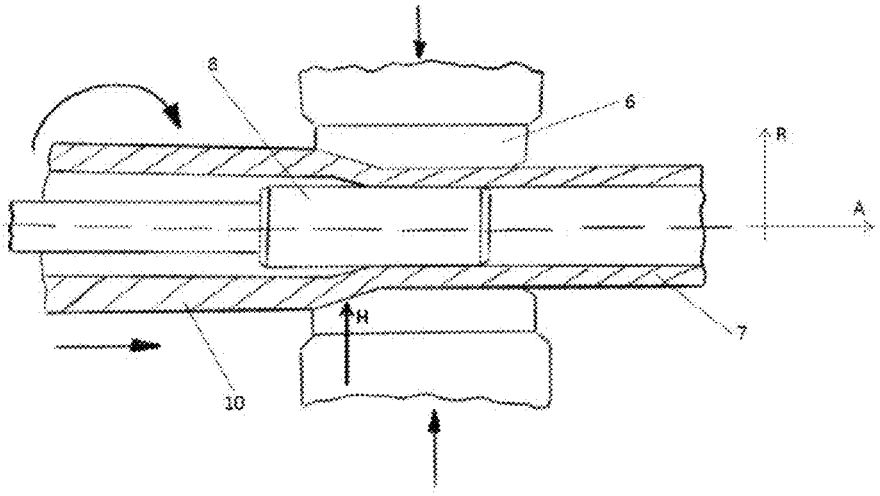
FIGS. 6*a*-6*f* depictions of various mechanical forming processes which come into question for the invention FIG. 7*a*, 7*b* a schematic illustration of taking of the samples for metallographic studies FIG. 8*a*, 8*b* a reference example for the invention showing the circumferential surface (a) and the end face (b) including grid pattern for quantitative evaluation of the microstructure

FIG. 6*a* shows a radial forging process with the option of radial tube forging. Radial forging represents free forming for narrowing the cross section of rods or, as shown in the example of FIG. 6*a*, of tubes made of metals. In this process, the starting workpiece 10 here is worked by two or more tool segments 6 which entirely or only partly surround the cross section to be worked. The tool segments 6 have a tapering shape. The starting workpiece 10 rotates around its own axis during the forging process and performs an advancing motion along its longitudinal direction, as indicated by the arrows. The tool segments 6 carry out a "hammering" motion as a result of performing a vibratory motion in the radial direction, as is likewise indicated by the arrows. The "hammering" motion deforms the starting workpiece 10 by means of the tool segments 6 to give a workpiece 7 having a smaller cross-sectional area. The desired internal diameter of the workpiece 7 which is worked here is ensured by the mandrel 8 depicted. The tube can be processed further to give a slinger ring 1 by means of a subsequent cutting-to-length process (for example by sawing or turning). How the main forming direction H corresponds to the radial direction R can readily be seen.

Figure 6B:
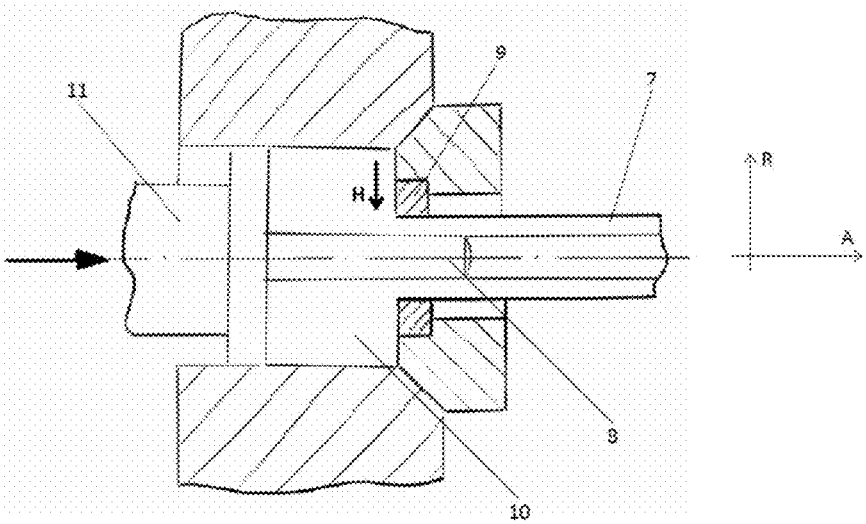

FIG. 6*b* shows an extrusion process. Here, a starting workpiece 10 is pressed by means of a punch 11 through a die 9 which has a cross section corresponding to that of the workpiece 7 to be produced. In the production of a tube (here specifically configured as a rotationally symmetric tube), it is possible to use a mandrel 8 which is joined to the punch 11 or is formed in one piece with the punch 11. After the extrusion process, the tube can be processed further to give a slinger ring 1 according to the invention by means of a cutting-to-length process. The main forming direction H corresponds to the radial direction R, by which means the features of a slinger ring according to the invention are achieved.

Figure 6C:
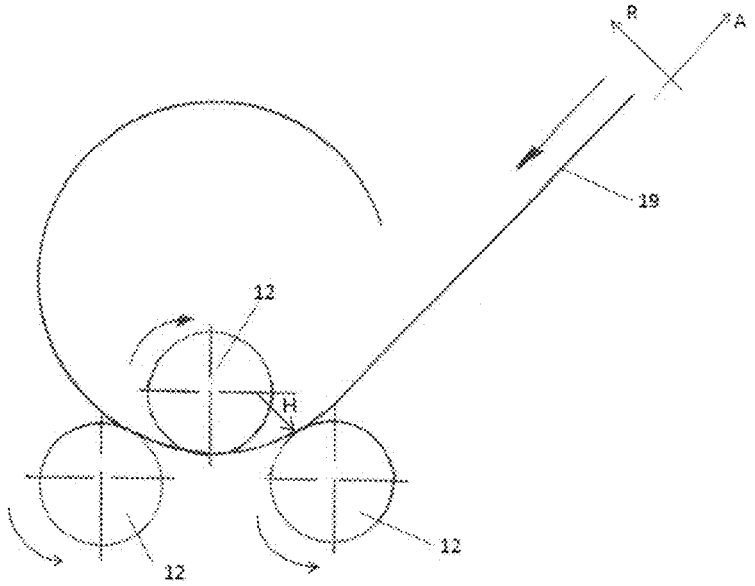

FIG. 6*c* shows a rolling process in which a flat rolled sheet 19 which has been preshaped in the radial direction resulting on the tube is brought to a tubular shape by an arrangement of rollers 12. The ends are then optionally joined to one another by metallurgical bonding, positive locking or a frictional join (for example by welding, soldering, adhesive bonding) and the tube can be processed further by cutting-to-length to give a slinger ring 1 according to the invention. Here too, the main forming direction H corresponds to the radial direction R of the metal sheet 19.

Figure 6D:
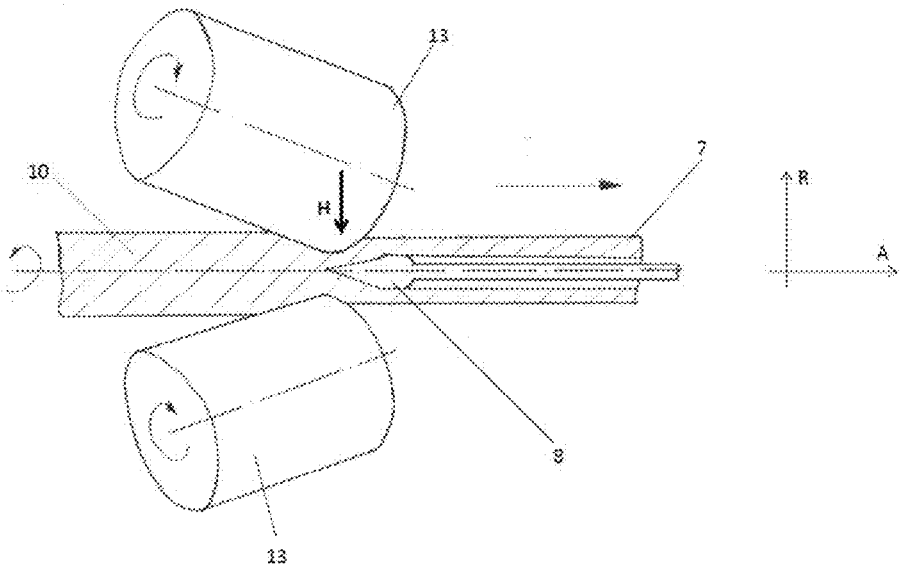

In tube rolling as shown in FIG. 6*d*, a starting workpiece 10 is passed between two rollers 13 which perform a corotational motion. These rollers 13 have their axes of rotation oriented at an angle to a rotational axis of the workpiece 7. As a result, counterrotation of the workpiece 7 relative to the rollers 13 and also plastic deformation of the starting workpiece 10 to give the resulting workpiece 7 are achieved. A mandrel 8 can be provided, as shown here. The workpiece 7, or tube, can subsequently be processed further by cutting-to-length to give a slinger ring 1 according to the invention. How the main forming direction H corresponds to the radial direction R in order to produce a slinger ring according to the invention can readily be seen.

Figure 6E:
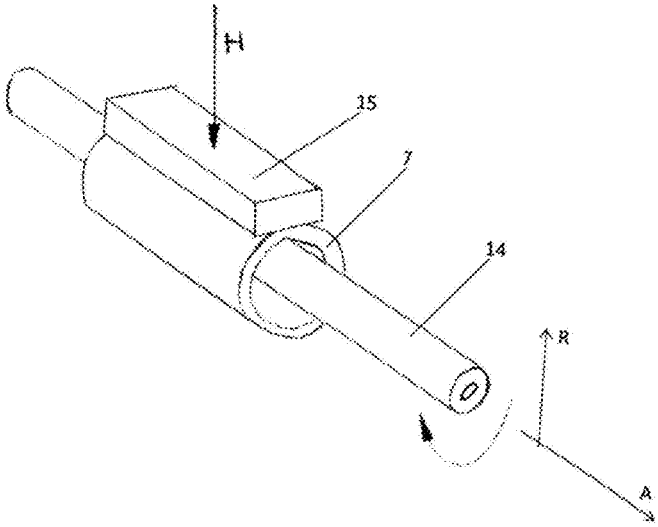

FIG. 6*e* shows a ring forging process. Here, the annular starting workpiece 10 is placed on a mandrel 14. A compressive force is exerted on the workpiece 7 by means of a forging press/forging hammer 15, bringing about deformation. After the pressure is released from the workpiece 7, the latter is turned further through a chosen angle and a compressive force is again exerted on the workpiece by means of a forging press/forging hammer 15. Here too, the main forming direction H corresponds to the radial direction R, as required in a slinger ring 1 according to the invention.

Figure 6F:
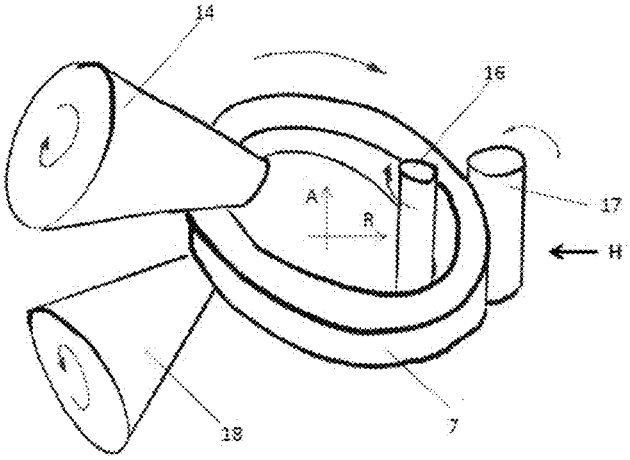

FIG. 6*f* shows a ring rolling process. Here, the starting workpiece 10 is already present as a ring. This workpiece 7 is deformed in the radial direction by means of a mandrel roller 16 and a main roller 17. The deformation of the workpiece 7 in the axial direction can be controlled by the axial rollers 18. This process is predominantly carried out as hot forming. After the ring rolling process, the workpiece 7, a slinger ring 1 according to the invention, can be processed further by means of cutting machining techniques (for example turning). Here, the main forming direction H corresponds to the radial direction R.

Other manufacturing processes are naturally also conceivable. Thus, a slinger ring according to the invention could well also be produced from a rolled metal sheet by deep-drawing a rolled metal sheet or processing the sheet by extrusion or pressing, ensuring that the main forming direction H of the starting metal sheet material extends in the resulting radial direction R of the slinger ring 1 according to the invention. After extrusion or pressing, the bottom of the resulting workpiece has to be or can be separated off in order to obtain a wheel.

LIST OF REFERENCE SYMBOLS

1 Slinger ring
2 Circumferential surface of the slinger ring
3 End face of the slinger ring
4 Melt spinning apparatus
5 Device for supplying a melt
6 Tool segment
7 Workpiece
8 Mandrel
9 Die
10 Starting workpiece
11 Punch
12 Roller
13 Roller
14 Mandrel
15 Forging press/forging hammer
16 Mandrel roller
17 Main roller
18 Axial roller
19 Metal sheet
20 Melt
21 Application nozzle
A Axial direction
R Radial direction
T Tangential direction
H Main forming direction
B Viewing direction
P Compressive force
$k_u$ Grain aspect ratio, circumference-side
$k_s$ Grain aspect ratio, end-face-side
$d_{mean}$ Mean grain size

The invention claimed is:

1. A slinger ring for a melt spinning apparatus, the slinger ring comprising:

a cylindrical main element composed of a refractory metal or a refractory metal-based alloy;

said main element having a circumferential surface running in a tangential direction and being delimited in an axial direction by two end faces; and said main element being mechanically shaped in a deformation process, with a degree of deformation of said main element in a radial direction being greater than a degree of deformation in the axial direction;

wherein an average circumference-side grain aspect ratio, which is obtained in a plan view onto said circumferential surface, is smaller than an average end-face-side grain aspect ratio, which is obtained in a plan view onto one of said two end faces.

2. The slinger ring according to claim 1, wherein the average circumference-side grain aspect ratio in the plan view onto the circumferential surface lies in a range of $1<ku<1.7$.

3. The slinger ring according to claim 1, wherein the average end-face-side grain aspect ratio, which is obtained in the plan view onto the one of the two end faces, is $1.5<=ks$.

4. The slinger ring according to claim 1, wherein an average grain size determined by a line intercept method on the circumferential surface is less than 500 μm.

5. The slinger ring according to claim 1, wherein said main element has a preferential orientation <111> and/or <100> normal to the circumferential surface (2).

6. The slinger ring according to claim 5, wherein the main element has a preferential orientation in the <111> direction having an intensity of greater than or equal to 1.5 times an underlying intensity normal to the circumferential surface.

7. The slinger ring according to claim 1, consisting essentially of a molybdenum-based alloy.

8. The slinger ring according to claim 1, consisting of a molybdenum-based alloy comprising ≥99 at % of molybdenum, MHC or TZM.

9. A melt spinning apparatus, comprising at least one slinger ring according to claim 1, a drive device for driving the at least one slinger ring and a device for supplying a melt to a circumferential surface of the at least one slinger ring.

10. The melt spinning apparatus according to claim 9, configured for rare earth magnet production.

* * * * *